US006314874B1

(12) United States Patent
Martorella

(10) Patent No.: US 6,314,874 B1
(45) Date of Patent: Nov. 13, 2001

(54) MANUAL TRASH COMPACTOR HAVING AN ADJUSTABLE ARM AND STABILIZING BLOCKS

(76) Inventor: Rudolph Martorella, 2 Spruce St., Apt. 4A, Great Neck, NY (US) 11021

( * ) Notice: Subject to any disclaimer, the term of this patent is extended or adjusted under 35 U.S.C. 154(b) by 0 days.

(21) Appl. No.: 09/443,529

(22) Filed: Nov. 19, 1999

(51) Int. Cl.[7] ..... B30B 1/00; B30B 5/00

(52) U.S. Cl. ..... 100/226; 100/227; 100/246; 100/247; 100/255; 100/265; 100/295

(58) Field of Search ..... 100/226, 227, 100/228, 229, 240, 245, 246, 247, 255, 265, 283, 293, 295

(56) References Cited

U.S. PATENT DOCUMENTS

| | | | | |
|---|---|---|---|---|
| 3,411,722 | * | 11/1968 | Webber | 100/245 |
| 3,760,718 | | 9/1973 | Adornetto . | |
| 3,850,094 | | 11/1974 | Shontz . | |
| 3,919,932 | | 11/1975 | Basuino . | |
| 3,946,662 | | 3/1976 | Ross, Jr. et al. . | |
| 4,050,373 | | 9/1977 | Hellmann . | |
| 4,128,055 | | 12/1978 | Hellmann . | |
| 4,331,074 | | 5/1982 | Behman . | |
| 4,658,720 | | 4/1987 | Massonnet . | |
| 5,024,374 | | 6/1991 | Ashby . | |
| 5,072,852 | | 12/1991 | Smith et al. . | |
| 5,619,915 | | 4/1997 | Wagner et al. . | |
| 5,730,047 | | 3/1998 | Lindsey . | |
| 5,845,567 | | 12/1998 | Fischer . | |

FOREIGN PATENT DOCUMENTS

| | | |
|---|---|---|
| 403 370 | 1/1998 | (AT) . |
| 2 135 322 | 12/1972 | (FR) . |
| 7903519 | 5/1979 | (NL) . |
| 8 501 293 | 12/1986 | (NL) . |

* cited by examiner

*Primary Examiner*—Peter Vo
*Assistant Examiner*—Louis Huynh
(74) *Attorney, Agent, or Firm*—Collard & Roe, PC.

(57) ABSTRACT

A manual trash compactor for a garbage can with an open top end and a closed bottom end. The compactor comprises a hood having an open top end and a bottom end that is attached to a top end of the garbage can. In addition, attached to the hood is a top or substantially closed surface wherein the top surface has at least one hole. There is also an adjustable arm that has a bottom end that is rotatably mounted on the top surface. The adjustable arm also has an opposite top end. Rotatably attached to the top end of the adjustable arm is a lever arm. A first end of the lever arm attaches to the adjustable arm while there is a second end that is spaced opposite the first end. Along the lever arm is a piston having a top end that is rotatably attached to the lever arm. The piston also has a bottom end that extends through the at least one hole in the top surface, with the bottom end extending into the garbage can. A compression plate is attached substantially perpendicular to the piston at the bottom end of the piston. Thus, to manually compress garbage in a garbage can, a user can close the top, and press down on the second end of the lever arm. This act rotates the adjustable arm and the lever arm so that the piston extends down, substantially perpendicular to the bottom end of the garbage can driving the compression plate onto the garbage and compacting the garbage between the compression plate and the bottom end of the garbage can.

16 Claims, 3 Drawing Sheets

21
28
40a
40b
22a
22b
18
34a
34b
10
32a
32b
26b
20
26a
24a
24b
16
14
12
12a

MANUAL TRASH COMPACTOR HAVING AN ADJUSTABLE ARM AND STABILIZING BLOCKS

BACKGROUND OF THE INVENTION

1. Field of the Invention

The invention relates to a manual trash compactor that has a bottom support. This manual trash compactor also contains an additional adjustable arm to help a lever arm keep a piston arm driving into a closed end of a garbage can.

2. Description of the Prior Art

Manual trash compactors are known in the art. For example, U.S. Pat. No. 5,730,047 to Lindsey discloses a manual trash compactor having a lever 17 and a grip handle 20. The lever is connected to a piston arm 23 and a compacting plate 24. Piston 17 connects to the garbage can via a pivot arm 16 that extends out from the garbage can. This pivot arm is unlike the adjustable hinge in the present invention because the pivot arm does not move.

U.S. Pat. No. 3,850,094 to Shontz discloses a manual trash compactor for a circular shaped garbage can. The manual trash compactor contains a lever 15 and an adjustable hinge formed by L-shaped lever handle 15 pivoting around pin 43. In addition, U.S. Pat. No. 3,919,932 to Basuino discloses a manually operated garbage compacting press which attaches to a wall on plate 18 and swings out via hinges 17. This design contains lever arm 22 which is connected to a piston 13 in its uppermost position. In both of these cases, these compactors do not contain a hinge that is attached to an edge of a garbage can.

U.S. Pat. No. 3,760,718 to Adornetto discloses a trash compactor attachment for a manual trash compactor. This trash compactor attachment is for compacting trash or garbage deposited therein. The compactor attachment includes a piston 45 with a head 46 for pressing against the deposited trash and a lever 60 arrangement for applying successive increments of pressure to the piston to compact the trash or garbage engaged by the head. However this invention does not disclose an adjustable hinge disposed on an edge of a top surface of a trash can.

U.S. Pat. No. 5,024,374 to Klepaki discloses a trash receptacle compactor for compacting trash in a trash receptacle enclosed in a housing including a piston disposed within the housing in alignment with the trash receptacle, and a lever means outside of the housing and interconnected with the piston for selectively operating the piston to compact trash within the receptacle.

U.S. Pat. Nos. 4,128,055 and 4,050,373 to Hellmann discloses a manual trash compactor having a compacting head that corresponds to the bottom plate in the present invention. In addition piston corresponds to the push rod in the present invention. However, this patent does not disclose a lever arm, or an adjustable hinge disposed on an edge of the garbage can. Finally, U.S. Pat. No. 5,845,567 to Fischer discloses a manual trash compactor that is wall mounted and has a piston disposed within a piston guide located on the wall.

While the prior art shows a manual trash compactor having a lever arm that rotates on a hinge, the prior art does not show an adjustable arm disposed on an edge of the garbage can that is used to center the piston and a compacting plate when compacting the garbage. Therefore the design of the present invention is novel over the prior art.

SUMMARY OF THE INVENTION

One object of the invention is to provide a piston for a manual trash compactor that extends substantially perpendicular to a bottom end of a garbage can to compact trash down into the garbage can.

Another object of the invention is to provide a bottom compacting plate for a trash compactor that remains substantially parallel to a bottom face of a garbage can during compaction.

Another object of the invention is to provide an adjustable lever arm for allowing the piston to remain substantially upright during compaction.

These and other objects are achieved by providing a manual trash compactor for a garbage can with an open end and a closed end. The compactor comprises a hood having an open end and an outer end that is attached to a top end of the garbage can. In addition, attached to the hood is a substantially closed surface wherein the substantially closed surface has at least one hole. There is also an adjustable arm that has a bottom end that is rotatably mounted on the substantially closed surface. The adjustable arm also has an opposite extended end. Rotatably attached to the extended end of the adjustable arm is a lever arm. A first end of the lever arm attaches to the adjustable arm a second end is spaced opposite the first end. Along the lever arm is a piston having a first end that is rotatably attached to the lever arm. The piston also has a second end that extends through the at least one hole in the substantially closed top surface, with the second end extending into the garbage can. A compression plate is attached substantially perpendicular to the piston at the second end of the piston.

Thus, to manually compress garbage in a garbage can, a user can close the top, or the substantially closed surface and press down on the second end of the lever arm. This act rotates the adjustable arm and the lever arm so that the piston extends down, substantially perpendicular to the bottom end of the garbage can driving the compression plate onto the garbage and compacting the garbage between the compression plate and the bottom end of the garbage can.

In one embodiment of the invention the manual trash compactor is for a free standing garbage can. In another embodiment of the invention the manual trash compactor is for a garbage can that slides in and out of a cabinet on a tray. In this second embodiment of the invention there is also a support means for supporting the tray above a floor once the garbage can is pulled out of a cabinet.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
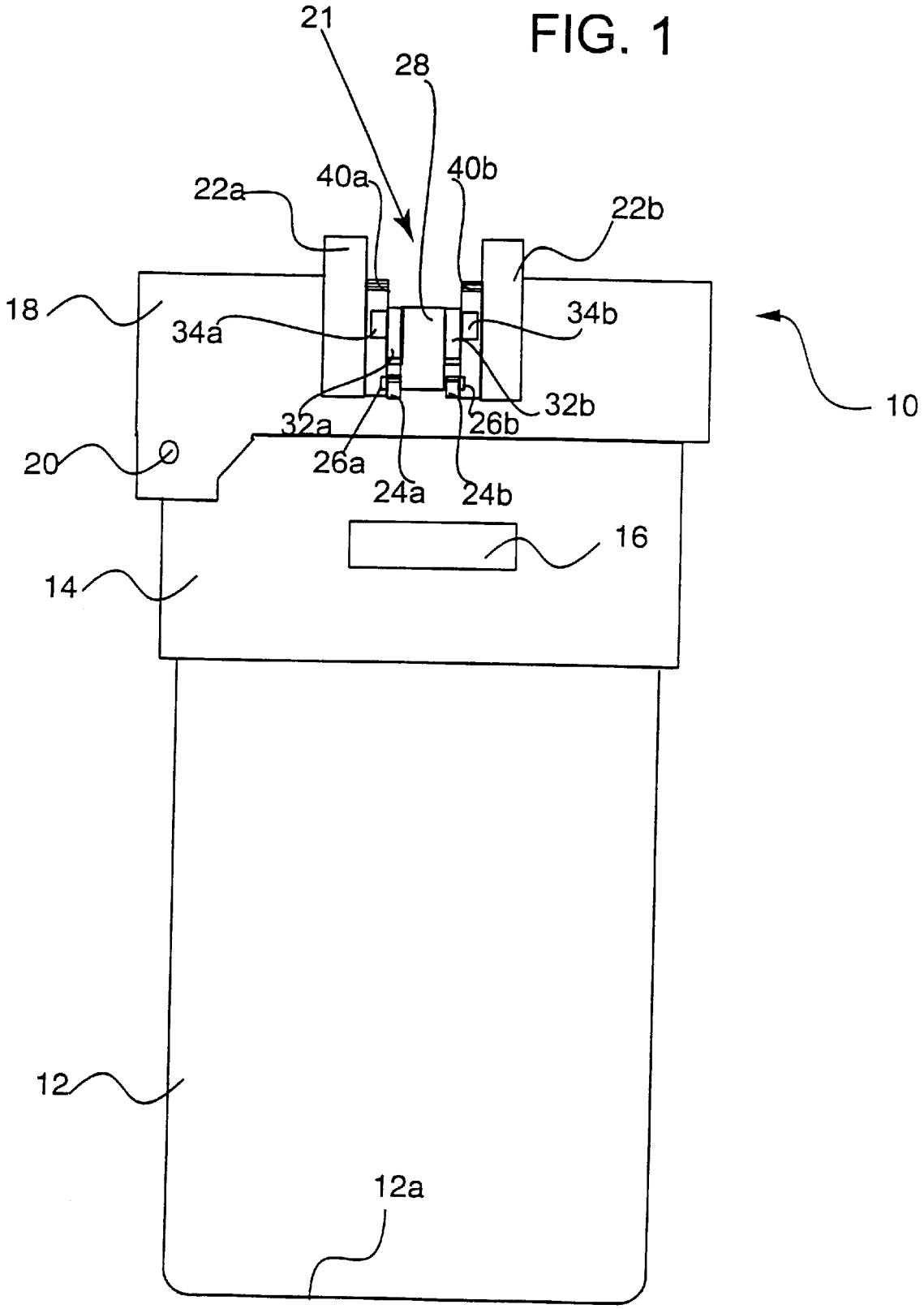
FIG. 1. shows a side view of the manual trash compactor according to the invention.

FIG. 1 shows a side view of the manual trash compactor 10 disposed on a garbage can 12. Disposed on top of can 12 is a hood 14 that fits over the top of can 12 and holds a garbage bag in place when placed over a can. Hood 14 has a handle 16 which allows can 12 to be lifted up. A substantially closed surface 18 is attached to hood 14 via a hinge 20. This allows substantially closed surface 18 to be lifted up to open can 12 to insert garbage.

Disposed in a channel 21 of closed surface 18 is a series of stabilizing blocks or guide elements 22*a* and 22*b* (See FIG. 3) that are aligned on either side of the channel 21. Inside channel 21 is a base hinge 24*a* and 24*b* that supports adjustable arm 28 via a screw (not shown) held in by nuts 26*a* and 26*b*. At an opposite end of adjustable arm 28 are two lever arm attachments 32*a* and 32*b* that attach to either side of adjustable arm 28 via a screw (not shown) and nuts 34*a* and 34*b*.

Figure 2:
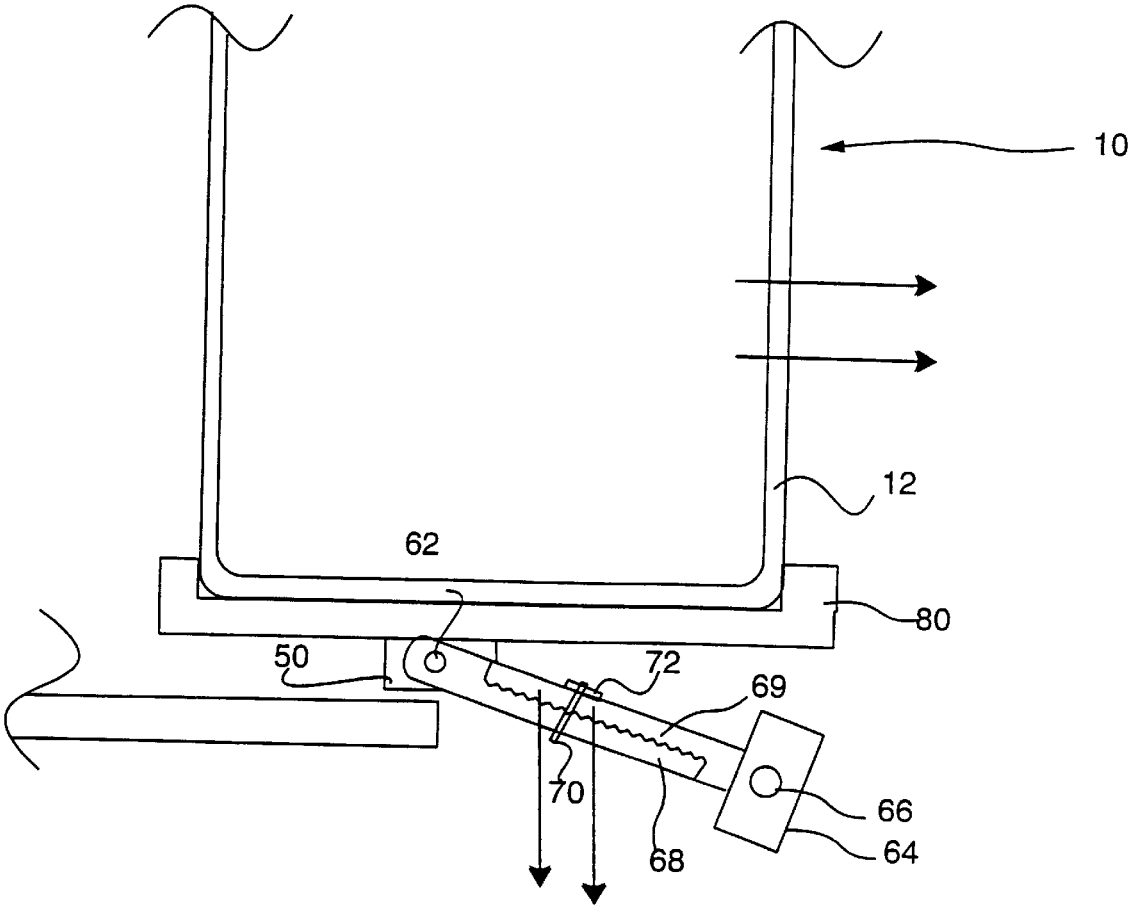
FIG. 2 shows a side view of the support means for the manual trash compactor.

FIG. 2 shows a side view of a bottom end of a second embodiment of the manual trash compactor. In this embodiment, garbage can 12 rests in a slidable tray 80 having a support means 48 attached to tray 80. Support means 48 includes a support block 50 attached to bottom surface 12*a*, a support shaft 60 having a first end rotatably mounted on support block 50 via an axle 62 and a bottom support block 64 rotatably mounted on a second end of support shaft 60 via an axle 66. Support shaft 60 contains a first section 68 that is connected to said support block So and a second section 69 that is connected to bottom support block 64. First section 68 contains an inner face having a saw toothed edge that interacts with a saw toothed edge on second section 69 so that support shaft does not self adjust during use. First section 68 is held to second section 69 via a screw 70 and a wing nut 72. When wing nut 72 is tightened, it locks first section 68 to second section 69 so that support shaft 60 remains substantially the same length.

Figure 3:
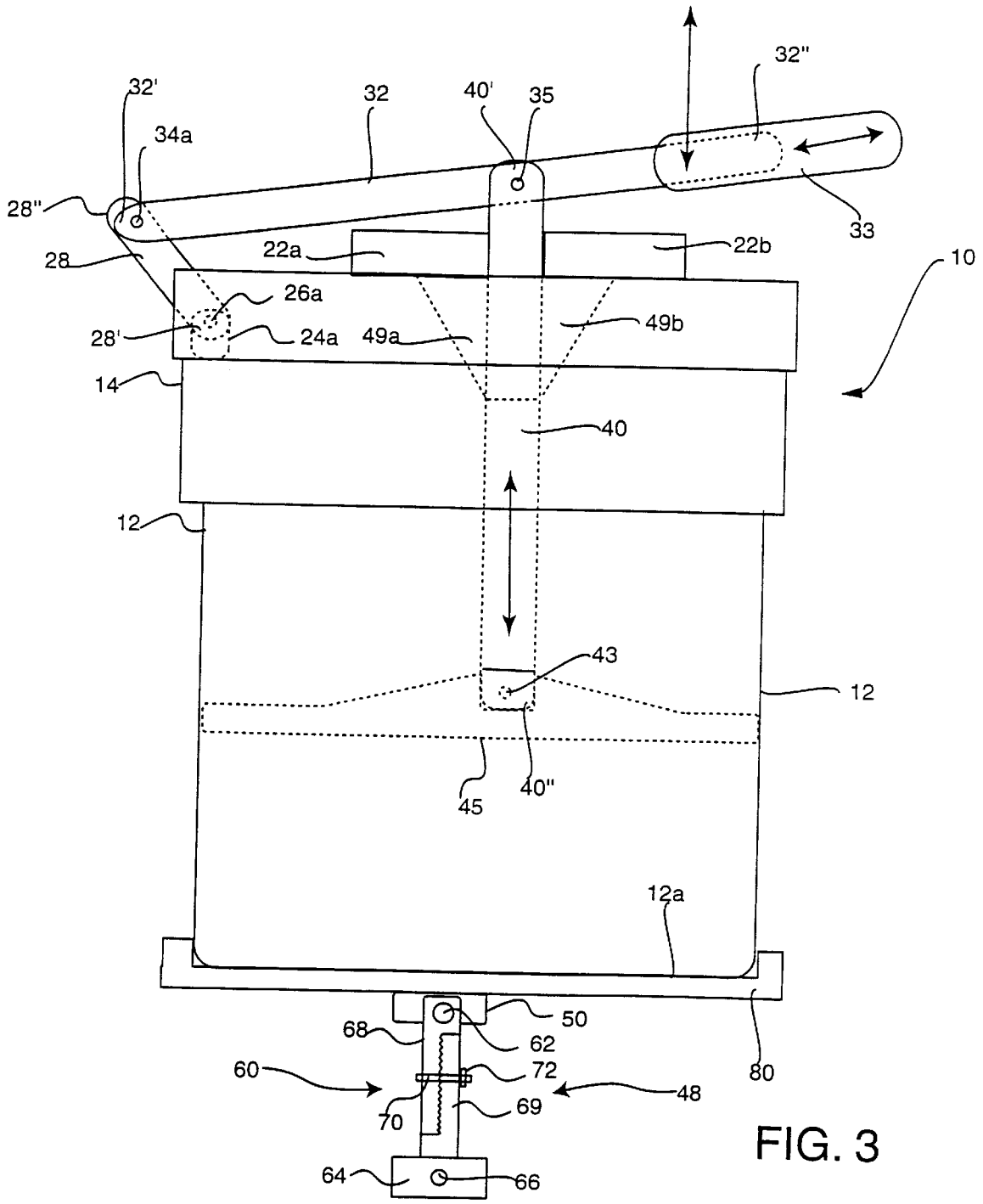
FIG. 3 shows a side view of the manual trash compactor with the support means extending down to the ground.

FIG. 3 shows a side view of the second embodiment of the manual trash compactor 10 in its compacted position. Lever arm 32 attaches to a first end 40' of a piston 40 having two piston arms 40*a* and 40*b* (FIG. 1). A second end 40" of piston 40 attaches to a compacting plate 45 at attachment point 43 so that compacting plate 45 remains substantially parallel to a bottom surface 12*a* of garbage can 12. This view shows how two sets of stabilizing blocks 22*a* and 22*b* guide piston 40 straight down substantially perpendicular to bottom surface 12*a* of garbage can 12. In addition disposed within can 12 is an additional set of triangular shaped guide elements 49*a* and 49*b* which are designed to guide piston arm 40 down substantially perpendicular to bottom surface 12*a*.

In addition, disposed on second end 32" of lever arm 32 is a telescoping handle 33 that can slide back and forth on lever arm 32. Telescoping handle 33 is used to give a person greater leverage when handling heavy loads of garbage. Handle 33 simply slides along lever arm 32 so that it creates greater leverage along lever arm 32 and greater momentum around the axle.

To compact trash in garbage can 12, a user first presses down on closed surface 18 securing closed surface 18 and hood 14 to can 12. The user can use his or her, hands, feet or knees to press down on surface 18. Next, the user grabs lever arm 32 whereby it is pushed down as shown in FIG. 3 driving piston 40 down into garbage can 12. At the bottom of piston 40 is compression plate 45 which is set substantially perpendicular to piston 40 and is pushed down by piston 40 towards bottom end 12*a* of garbage can 12. Thus, garbage is compressed between compression plate 45 and bottom end 12*a*.

Accordingly, while several embodiments of the present invention have been shown and described, it is to be understood that many changes and modifications may be made thereunto without departing from the spirit and scope of the invention as defined in the appended claims.

What is claimed is:

1. A manual trash compactor having a garbage can with an open end and a closed end, the compactor comprising:

a) a hood having an open end disposed over the open end of the garbage can;

b) a substantially closed surface attached to said hood wherein said substantially closed surface has at least one hole;

c) an adjustable arm having a first end rotatably mounted on said substantially closed surface and an opposite spaced extending end;

d) a lever arm having a first end rotatably attached to said extending end on said adjustable arm, and wherein said lever arm has a second end spaced opposite said first end;

e) a piston having a first end rotatably attached to said lever arm and a second end that extends through said at least one hole in said substantially closed surface; and f) a compression plate attached to said second end of said piston wherein to manually compress garbage in a garbage can, a user can press on said substantially closed surface to hold said substantially closed surface and said hood on the garbage can, press on said second end of said lever arm, rotating said adjustable arm and said lever arm so that said piston extends into the garbage can substantially perpendicular to the closed end of the garbage can compressing the garbage between said compression plate and the closed end of the garbage can.

2. The manual trash compactor as claimed in claim 1, wherein said lever arm further comprises a telescoping handle that extends out along said lever arm away from said first end on said lever arm.

3. The manual trash compactor as claimed in claim 1, wherein said hood fits over the garbage can and is alternately removeable from or insertable onto the garbage can.

4. The manual trash compactor as claimed in claim 1, wherein said hood contains a handle for lifting said hood and the garbage can together.

5. The manual trash compactor as claimed in claim 1, wherein said substantially closed surface is rotatably mounted on said hood via a hinge so that garbage can be inserted into the garbage can.

6. The manual trash compactor as claimed in claim 1, further comprising a base bracket attached to said substantially closed surface wherein said base bracket is used to rotatably mount said adjustable arm onto said substantially closed surface.

7. The manual trash compactor as claimed in claim 1, further comprising a stabilizing means for stabilizing said piston arm substantially perpendicular to the closed end of the garbage can.

8. The manual trash compactor as claimed in claim 7, wherein said stabilizing means comprises a series of stabilizing blocks for stabilizing said piston substantially perpendicular to the closed bottom end.

9. The manual trash compactor as claimed in claim 1, further comprising a support means for supporting the closed end of the garbage can while garbage is being compressed in the garbage can.

10. A manual trash compactor having a garbage can with an open end and a closed end, the compactor comprising:

a) a hood disposed over the open end of the garbage can;

b) a substantially closed surface attached to said hood wherein said substantially closed surface has at least one hole;

c) an adjustable arm having a first end rotatably mounted on said substantially closed surface and an opposite spaced extending end;

d) a lever arm having a first end rotatably attached to said extending end on said adjustable arm, and wherein said lever arm has a second end spaced opposite said first end;

e) a piston having a first end rotatably attached to said lever arm and a second end that extends through said at least one hole in said substantially closed surface; and f) a compression plate attached to said second end of said piston;

g) a tray disposed below the garbage can holding the can therein;

h) a support block coupled to the tray;

i) a support shaft rotatably mounted on said support block said support shaft for supporting said tray above a surface;

wherein to manually compress garbage in a garbage can, a user can press on said substantially closed surface to hold said substantially closed surface and said hood on the garbage can, and press on said second end of said lever arm, rotating said adjustable arm and said lever arm so that said piston extends into the garbage can substantially perpendicular to the closed end of the garbage can, compressing the garbage between said compression plate and the closed end of the garbage can.

11. The manual trash compactor as claimed in claim 10, wherein said first end of said support shaft is rotatably mounted to said support block, and said support block is rotatably mounted to said second end of said support shaft wherein when said trash compactor is pulled out of an enclosure, said support shaft drops down, allowing said support shaft to rotate on said support block so that said bottom support block contacts a support surface so that the closed end of the garbage can is supported by said bottom support block and said support shaft when said garbage is being compacted.

12. The manual trash compactor as claimed in claim 11, further comprising a locking bracket for locking said support shaft in place so that said support shaft remains substantially immobile when said support shaft has dropped down into a support position.

13. The manual trash compactor as claimed in claim 11, further comprising a bottom support block coupled to said support shaft, wherein said support shaft comprises a first section attached to said support block and a second section attached to said bottom support block.

14. The manual trash compactor as claimed in claim 13 wherein said first section of said support shaft is coupled to said second section of said support shaft via a bolt and a wing nut.

15. The manual trash compactor as claimed in claim 14, wherein said first section of said support shaft has an inner face that is saw toothed and said second section has an inner face that is saw toothed so that said inner face on said first section matches with said inner face on said second section to prevent said inner face of said first section from slipping against said inner face of said second section.

16. A manual trash compactor having a garbage can with an open end and a closed end, the compactor comprising:

a) a hood disposed over the open end of the garbage can;

b) a substantially closed surface attached to said hood wherein said substantially closed surface has at least one hole;

c) an adjustable arm having a first end rotatably mounted on said substantially closed surface and an opposite spaced extending end;

d) a lever arm having a first end rotatably attached to said extending end on said adjustable arm, and wherein said lever arm has a second end spaced opposite said first end;

e) a piston having a first end rotatably attached to said lever arm and a second end that extends through said at least one hole in said substantially closed surface; and f) a compression plate attached to said second end of said piston;

g) a plurality of guide elements coupled to said cover, said guide elements being positioned both above and below said cover for guiding said piston within the garbage can;

h) a support shaft rotatably mounted on said support block said support shaft for supporting said tray above a surface;

wherein to manually compress garbage in a garbage can, a user can press on said substantially closed surface to hold said substantially closed surface and said hood on the garbage can, and press on said second end of said lever arm, rotating said adjustable arm and said lever arm so that said piston extends into the garbage can substantially perpendicular to the closed end of the garbage can, compressing the garbage between said compression plate and the closed end of the garbage can.

* * * * *